US008177450B2

(12) United States Patent
Zhang

(10) Patent No.: US 8,177,450 B2
(45) Date of Patent: May 15, 2012

(54) STRUCTURE FOR MAKE-UP PEN WITH FUNCTION OF VIBRATION MASSAGE

(75) Inventor: Jun Zhang, Sijhih (TW)

(73) Assignee: Chuen Chern Co. Ltd, Taipei County (TW)

( * ) Notice: Subject to any disclaimer, the term of this patent is extended or adjusted under 35 U.S.C. 154(b) by 306 days.

(21) Appl. No.: 12/580,377

(22) Filed: Oct. 16, 2009

(65) Prior Publication Data

US 2011/0091265 A1 Apr. 21, 2011

(51) Int. Cl.
*B43K 1/06* (2006.01)

(52) U.S. Cl. ..... 401/265; 401/216

(58) Field of Classification Search ..... 401/1, 2, 401/195, 216, 262, 265, 266
See application file for complete search history.

(56) References Cited

U.S. PATENT DOCUMENTS

| | | | | |
|---|---|---|---|---|
| 5,247,218 | A * | 9/1993 | Sven | 310/81 |
| 7,644,589 | B2 * | 1/2010 | Habatjou | 62/60 |
| 2003/0171702 | A1 * | 9/2003 | Thompson et al. | 601/72 |
| 2007/0098483 | A1 * | 5/2007 | Milesi et al. | 401/209 |
| 2010/0310298 | A1 * | 12/2010 | Tsai | 401/143 |

* cited by examiner

*Primary Examiner* — David J. Walczak

(57) ABSTRACT

An improved structure for a make-up pen with a function of vibration massage comprises an accommodating tube body, a discharging set, a cover, a shelter, a battery cover, an elastic element, a battery, a vibration motor, a tumbler switch, and a switch piece. The accommodating tube body comprises an outlet end, which has a discharging hole. The discharging set is disposed at the outlet end of the accommodating tube body; the cover is female-connected to the outlet end of the accommodating tube body one end of the switch piece is disposed at the tumbler switch and the other end is electrically connected to the battery, the switch piece is electrically connected to the vibration motor through the tumbler switch in order to turn on/off the vibration motor for massage and discharging make-up liquid.

6 Claims, 7 Drawing Sheets

STRUCTURE FOR MAKE-UP PEN WITH FUNCTION OF VIBRATION MASSAGE

BACKGROUND OF THE INVENTION

1. Field of the Invention

The present invention generally relates to the technical field of a make-up pen, more particularly, to an improved structure for a make-up pen with vibration massage function.

2. Description of the Prior Art

Normally a prior massage make-up pen has an accommodating body, a plug member and a cover. The plug member has a through hole, a roller being disposed in the through hole, and some make-up liquid in the accommodating body. The plug member is inserted into the outlet port of the accommodating body. The peripheral surface of the outlet port of the accommodating body has outer threads, and the cover has inner threads. The outer threads and the inner threads can then be cooperated each other in order to tightly combine the cover and the accommodating body. Thus, the discharge through the roller reaches the function of massage.

Unfortunately such prior make-up pen is short of vibration so that the effect of massage is limited. In addition, the liquid inside the pen may leak out while the pen is under a static situation or pressed, since there is no design for anti-leaking. Moreover, some leaked liquid should be wiped out before reopening the pen. It is very inconvenient. Further, since the liquid directly flows to the roller that the amount of the outgoing liquid is hard to be controlled. Thus, too much liquid going out causes the problem of waste. The liquid being pressed out cannot be retracted into the pen, because it will contaminate the original clean liquid inside the pen. As a conclusion, the prior make-up pen may not reach the present needs in our daily lives, and thus, must be improved.

SUMMARY OF THE INVENTION

According to the aforesaid, an improved structure for a make-up pen with vibration massage function is provided and comprises: an accommodating tube body, a discharging set, a cover, a shelter, a battery cover, a spring, a battery, a vibration motor, a tumbler switch, and a switch piece. The accommodating tube body comprises an outlet end, which has a discharging hole; the discharging set is disposed at the outlet end of the accommodating tube body; the cover is female-connected to the outlet end of the accommodating tube body; one end of the switch piece is disposed at the tumbler switch and the other end is electrically connected to the battery; the switch piece is electrically connected to the vibration motor through the tumbler switch in order to turn on/off the vibration motor for massage and discharging make-up liquid.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
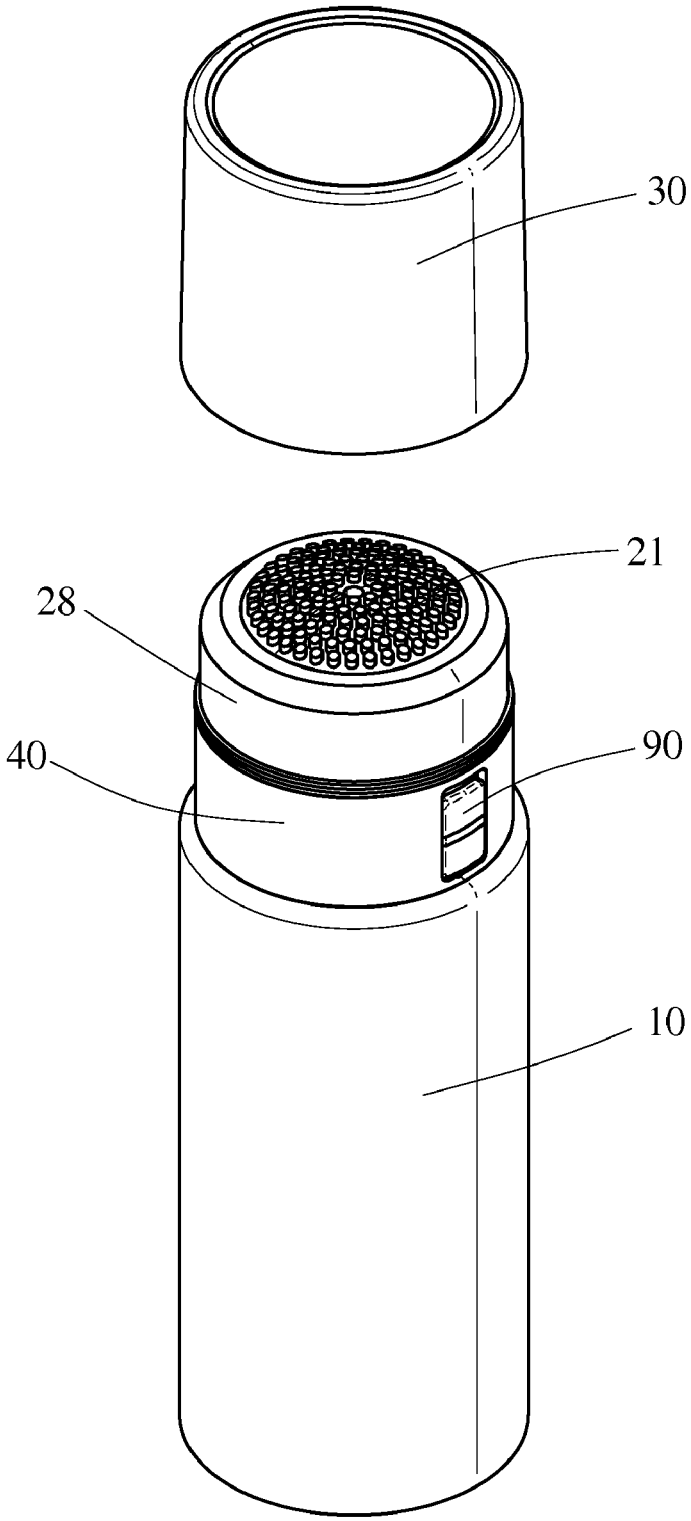
FIG. 1 illustrates a schematic 3-D view of a preferred embodiment of the present invention.
Figure 2:
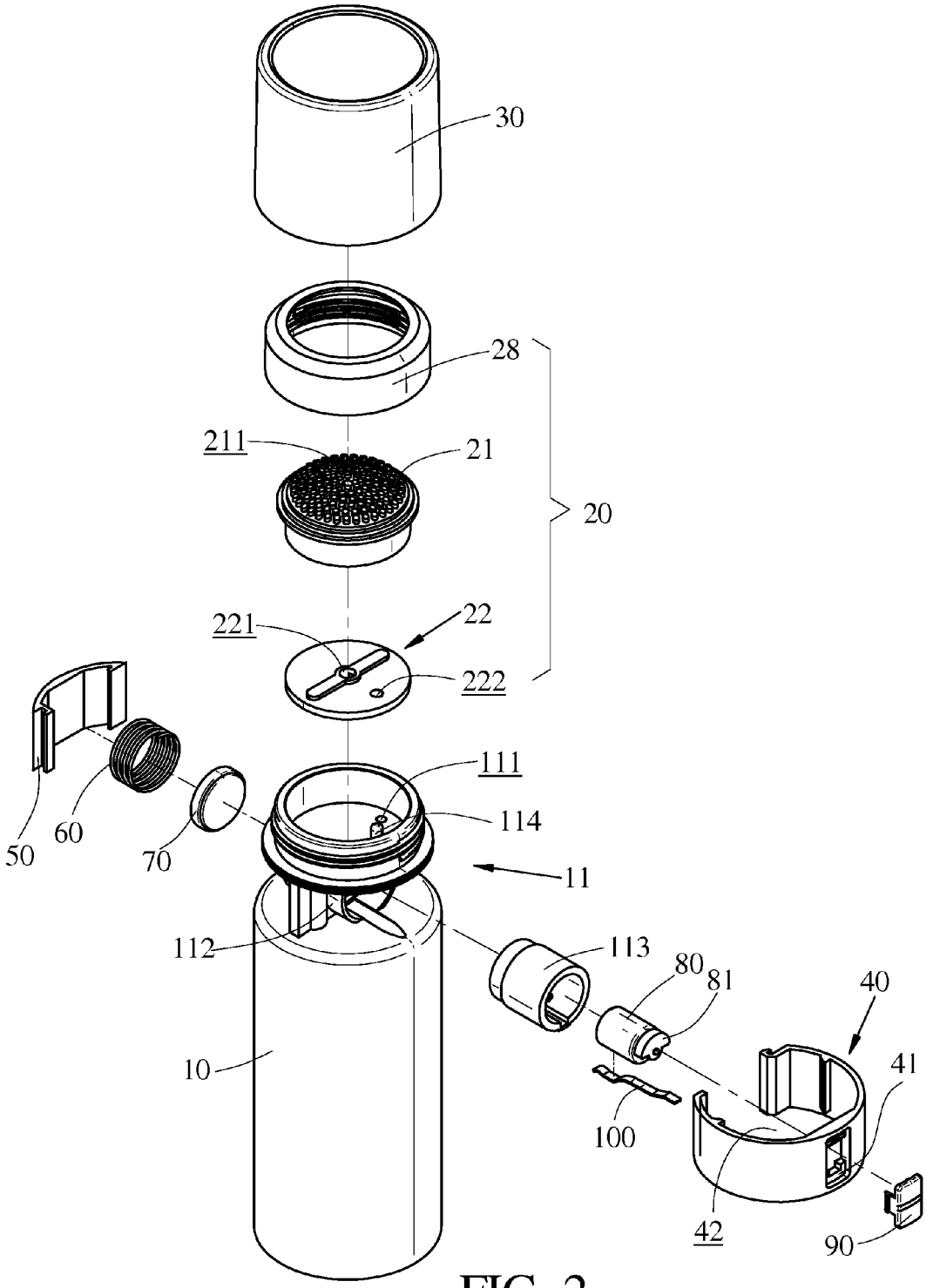
FIG. 2 illustrates a schematic exploded view of the preferred embodiment of the present invention.
Figure 2A:
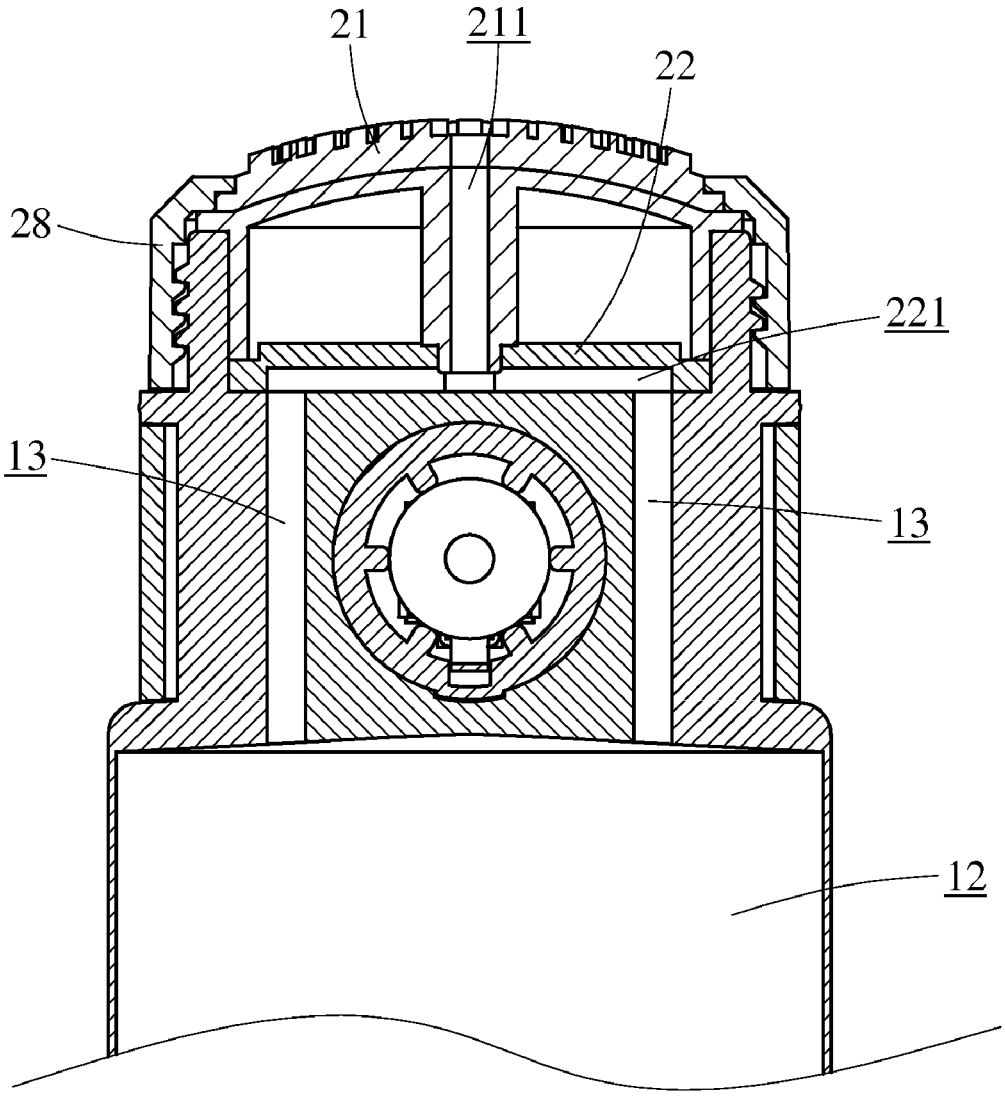
FIG. 2A illustrates a schematic discharging sectional view of the preferred embodiment of the present invention.
Figure 3:
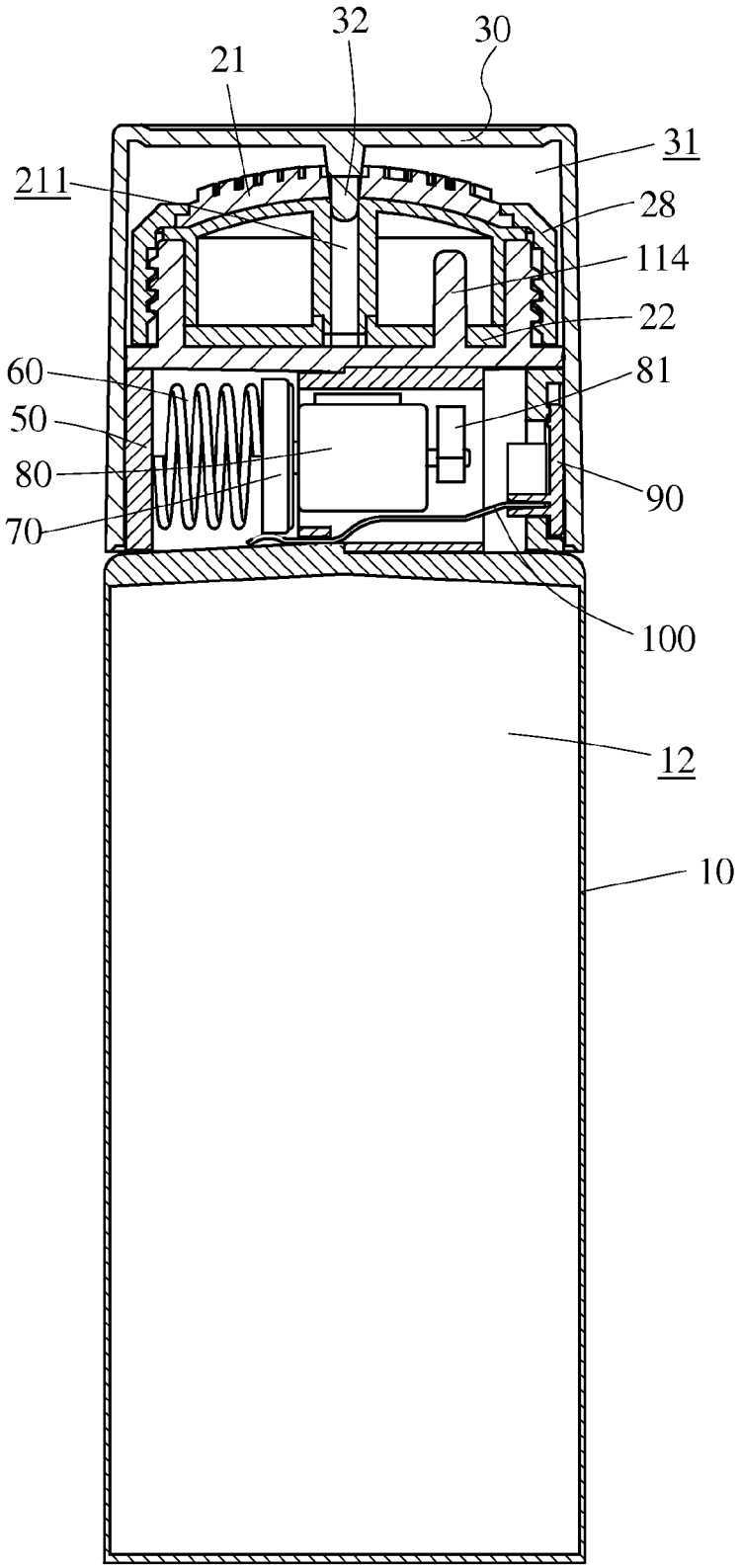
FIG. 3 illustrates a schematic sectional view of a vibration structure in a close status of the preferred embodiment of the present invention.
Figure 4:
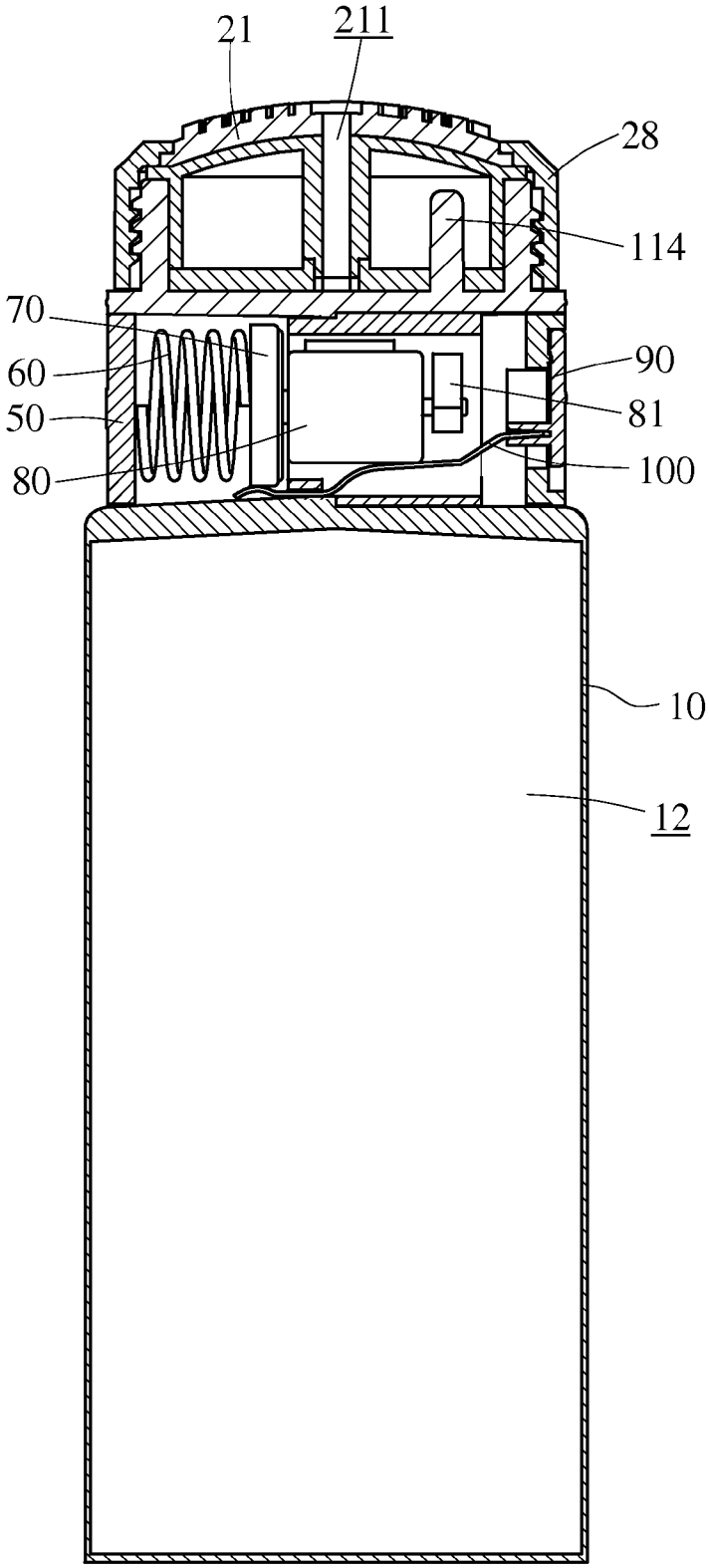
FIG. 4 illustrates a schematic sectional view of the vibration structure in an open status of the preferred embodiment of the present invention.
Figure 5:
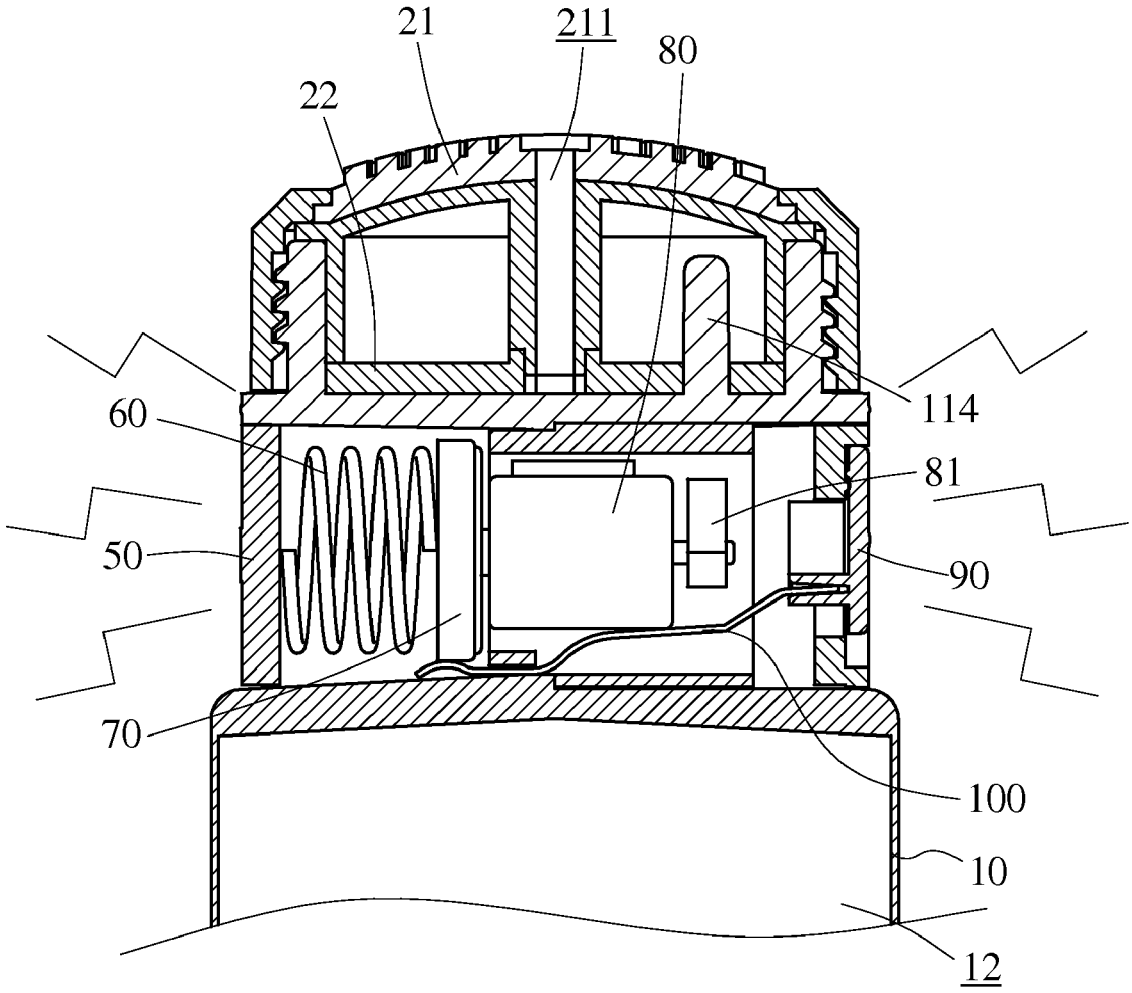
FIG. 5 illustrates a schematic partial sectional view of the vibration structure in the open status of the preferred embodiment of the present invention.

Following preferred embodiments and figures will be described in detail so as to achieve aforesaid object.

With references to FIG. 1 to FIG. 6, the present invention provides an improved structure of a make-up pen with vibration massage function which includes an accommodating tube body 10, a discharging set 20, a cover 30, a shelter 40, a battery cover 50, a spring 60, a battery 70, a vibration motor 80, a tumbler switch 90, and a switch piece 100. The accommodating tube body 10 has an outlet end 11, a first accommodating trough 12 and at least a first discharging channel 13. The discharging channel is connected to the first accommodating trough 12, and the outlet end 11 has a discharging hole 111 and an accommodating base 112.

The discharging set 20 is disposed at the outlet end 11 of the accommodating tube body 10; the cover 30 has a first accommodating room 31 and is female-connected to the outlet end 11 of the accommodating tube body 10; the discharging set 20 is accommodated in the first accommodating room 31; the shelter 40 includes a switch base 41 and is firmly disposed at the accommodating base 112 of the accommodating tube body 10.

The battery cover 50 is disposed at the shelter 40, wherein a second accommodating room 42 is formed between the battery cover 50 and the shelter 40. The battery 70 and the battery cover 50 are replaceable, and the battery 70 can be replaced only by sliding the battery cover 50. The spring 60 is disposed in the second accommodating room 42; the battery 70 is disposed in the second accommodating room 42, the spring 60 is disposed between the battery cover 50 and the battery 70; the vibration motor 80 is firmly disposed at the accommodating base 112 and in the second accommodating room 42. The vibration motor 80 is electrically connected to the battery 70.

The tumbler switch 90 is disposed at the switch base 41 of the shelter 40; the switch piece 100 is disposed in the second accommodating room 42; one end of the switch piece 100 is disposed at the tumbler switch 90 and the other end is electrically connected to the battery 70. The switch piece 100 is electrically connected to the vibration motor 80 through the tumbler switch 90 in order to turn on/off the vibration motor 80 for massage.

Wherein the accommodating base 112 further comprises a battery base 113, and the battery 70 is disposed at one end of the battery base 113; the vibration motor 80 is disposed in the other end of the battery base 113.

Wherein the vibration motor 80 comprises a rotational shaft and a bias rotational block 81. The bias rotational block 81 is firmly disposed at the rotational shaft, and vibration is thus generated through revolving the rotational shaft to drive the bias rotational block 81 to rotate.

Wherein the discharging set 20 comprises a discharging head 21, a discharging piece 22 and a fixing ring member 28. The fixing ring member 28 is capable of fastening the discharging head 21 and the discharging piece 22 at the outlet end 11, a limit convex column 114 is disposed at the outlet end 11. The discharging piece 22 is covered by the discharging head 21, while the discharging head 21 has a second discharging channel 211 therethrough. The discharging piece 22 has a discharging trough 221 and a limit hole 222; the limit convex column 114 goes through the limit hole 222 in order to limit the discharging piece 22, so that the discharging hole 111 of the accommodating tube body 10 can be leveled at and connected to the discharging trough 221 of the discharging piece 22. The discharging trough 221 is connected to the second discharging channel 211 of the discharging head 21 for discharging.

Wherein the cover 30 further comprises a jamming block 32 therein, which is to jam the second discharging channel 211 of the discharging head 21.

Figure 6:
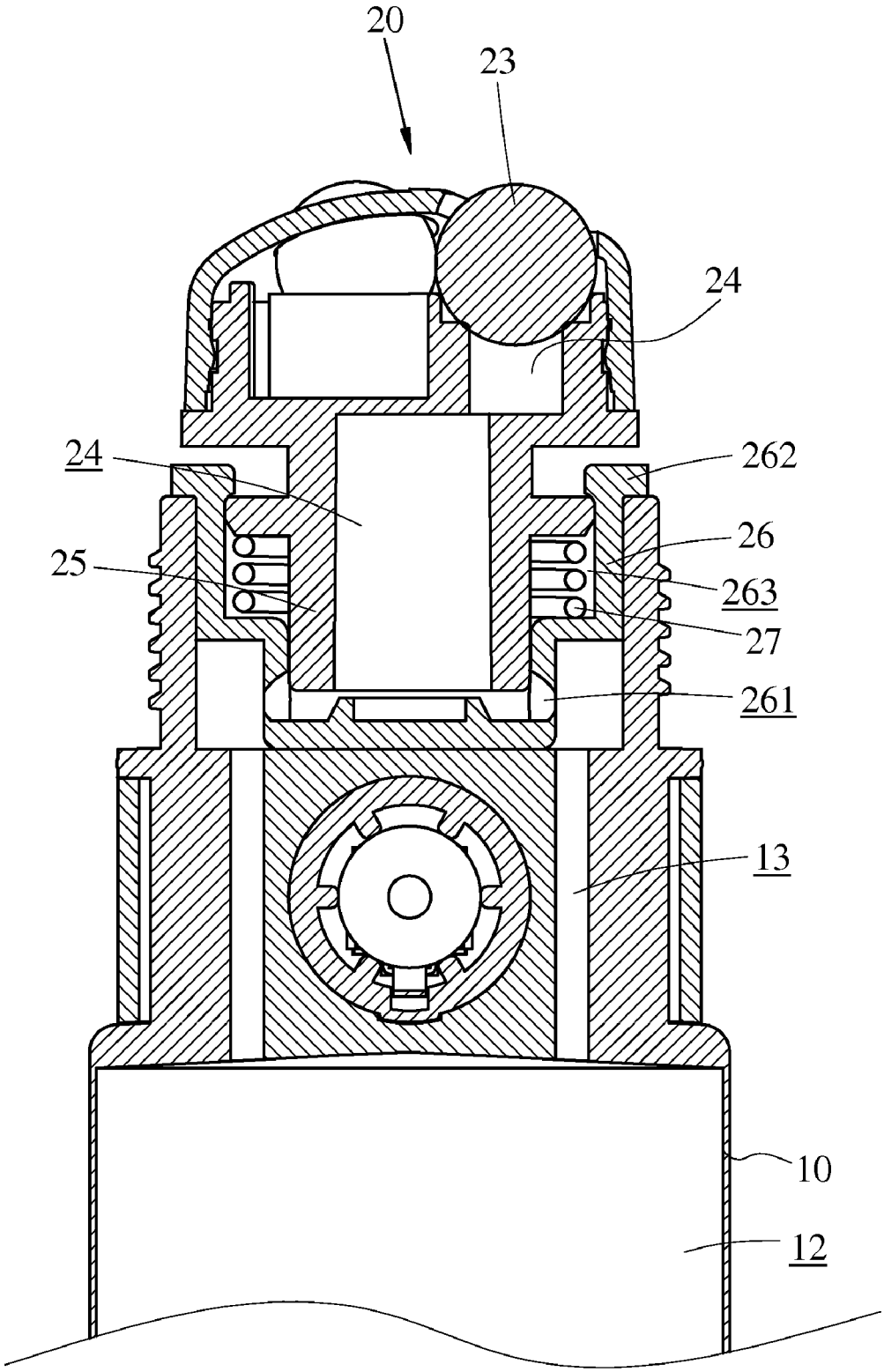
FIG. 6 illustrates a schematic partial sectional view of another preferred embodiment of the present invention.

As can be seen in FIG. 6, the discharging set 20 is hollow and comprises a roller discharging head 23, a second discharging channel 24, a piston rod 25, and a sleeve 26. The roller discharging head 23 is disposed at the piston rod 25; the second discharging channel 24 is formed in the piston rod 25; the sleeve 26 includes a discharging port 261, an outer edge 262, and a sleeve accommodating trough 263. The sleeve accommodating trough 263 is disposed in the piston rod 25, an elastic element 27 is placed between the piston rod 25 and the sleeve 26. The outer edge 262 of the sleeve 26 is limited to the outlet end 11 of the accommodating tube body 10. screwing the cover 30 clockwise or counterclockwise can jam the piston rod 25 of the discharging set 20 or make the connection of the piston rod 25 and the discharging port 261, so that the first accommodating trough 12 and the second discharging channel 24 can be connected or not connected to each other.

As a conclusion, the present invention is not only capable of having the function of discharging make-up liquid, but also the function of vibration massage, because of the vibration motor. Further, the present invention has another mechanism such as a valve to control the outgoing amount of the make-up liquid; and the piston rod may jam the outlet port, so that the effects of anti-leaking and air-seal are improved.

What is claimed is:

1. An improved structure for a make-up pen with a function of vibration massage, comprising: an accommodating tube body, comprising an outlet end, a first accommodating trough and at least a first discharging channel, which is connected to the first accommodating trough, the outlet end having a discharging hole and an accommodating base; a discharging set, disposed at the outlet end of the accommodating tube body; a cover, comprising a first accommodating room and female-connected to the outlet end of the accommodating tube body, the discharging set being accommodated in the first accommodating room; a shelter, comprising a switch base and firmly disposed at the accommodating base of the accommodating tube body; a battery cover, disposed at the shelter, wherein a second accommodating room is formed between the battery cover and the shelter; a spring, disposed in the second accommodating room; a battery, disposed in the second accommodating room, wherein the spring is disposed between the battery cover and the battery; a vibration motor, firmly disposed at the accommodating base and in the second accommodating room, the vibration motor being electrically connected to the battery; a tumbler switch, disposed at the switch base; and a switch piece, disposed in the second accommodating room, one end of the switch piece being disposed at the tumbler switch and the other end being electrically connected to the battery, the switch piece being electrically connected to the vibration motor through the tumbler switch in order to turn on/off the vibration motor for massage.

2. The improved structure for the make-up pen with the function of vibration massage according to claim 1, wherein the accommodating base comprises a battery base, the battery being disposed at one end of the battery base, the vibration motor being disposed in the other end of the battery base.

3. The improved structure for the make-up pen with the function of vibration massage according to claim 1, wherein the vibration motor comprises a rotational shaft and a bias rotational block, the bias rotational block being firmly disposed at the rotational shaft, vibration being thus generated through revolving the rotational shaft to drive the bias rotational block to rotate.

4. The improved structure for the make-up pen with the function of vibration massage according to claim 1, wherein the discharging set comprises a discharging head and a discharging piece, a limit convex column being disposed at the outlet end, the discharging piece being covered by the discharging head, the discharging head having a second discharging channel therethrough, the discharging piece having a discharging trough and a limit hole, the limit convex column going through the limit hole in order to limit the discharging piece, so that the discharging hole of the accommodating tube body is leveled at and connected to the discharging trough of the discharging piece, the discharging trough being connected to the second discharging channel of the discharging head for discharging.

5. The improved structure for the make-up pen with the function of vibration massage according to claim 4, wherein the cover further comprises a jamming block therein, which is to jam the second discharging channel of the discharging head.

6. The improved structure for the make-up pen with the function of vibration massage according to claim 1, wherein the discharging set is hollow and comprises a roller discharging head, a second discharging channel, a piston rod, and a sleeve, the roller discharging head being disposed at the piston rod, the second discharging channel being formed in the piston rod, the sleeve comprising a discharging port, an outer edge, and a sleeve accommodating trough, the sleeve accommodating trough being disposed in the piston rod, an elastic element being disposed between the piston rod and the sleeve, the outer edge of the sleeve being limited to the outlet end of the accommodating tube body, wherein screwing the cover clockwise or counterclockwise jams the piston rod of the discharging set or make the connection of the piston rod and the discharging port, so that the first accommodating trough and the second discharging channel are connected or not connected to each other.

* * * * *